United States Patent [19]

Masano

[11] Patent Number: 4,733,600

[45] Date of Patent: Mar. 29, 1988

[54] APPARATUS FOR CONTROLLING CARGO HANDLING POSITION

[75] Inventor: Nobuo Masano, Ryugasaki, Japan

[73] Assignee: Toyo Unpanki Co., Ltd., Osaka, Japan

[21] Appl. No.: 20,735

[22] Filed: Mar. 2, 1987

[30] Foreign Application Priority Data

May 9, 1986 [JP] Japan ..... 61-70334

[51] Int. Cl.[4] ..... F15B 9/09

[52] U.S. Cl. ..... 91/358 A; 91/461; 414/701

[58] Field of Search ..... 91/358 A, 358 R, 461; 414/699, 701

[56] References Cited

U.S. PATENT DOCUMENTS

| | | | |
|---|---|---|---|
| 3,924,766 | 12/1975 | Canning | 414/701 |
| 4,037,519 | 7/1977 | Miller | 91/358 A X |
| 4,469,007 | 9/1984 | Melocik | 91/358 A |

*Primary Examiner*—Robert G. Nilson

*Attorney, Agent, or Firm*—Wenderoth, Lind & Ponack

[57] ABSTRACT

An apparatus for controlling the angular position of the booms of an earthwork vehicle such as a wheeled tractor loader includes a shock absorber, by which the hydraulic pressure to be applied to a cargo handling valve for changing the position of a valve spool therein is lowered so as to lessen the shocks which are felt when the booms come to a stop position.

1 Claim, 5 Drawing Figures

9
1B
1
1A
14B
11
18
3
15A
4B
4
4C
15B
4a
14A
a
b
f
e
2
2A
2B
c
d
2D
20
16A
g
h
16B
2C
17A
17B
k
4A
6A
13
5
5A
13
17
m
6
19
13
10
7
12
12f
12g
12d
12b
12e
12a
12c
10b
10a
12A

APPARATUS FOR CONTROLLING CARGO HANDLING POSITION

The present invention relates to an apparatus for controlling cargo handling position for earthwork vehicles such as wheel loaders.

FIGS. 4 and 5 show a conventional cargo handling apparatus for earthwork vehicles such as wheel loaders. This apparatus is provided with a cargo handling valve 2 to control a cargo handling device 1 formed with a hydraulic cylinder or the like, a control valve 4 connected to the cargo handling valve 2 through a fluid pressure circuit 3 to give off fluid pressure signals for switching valve position, and retainers 5, 6 to retain a lever 4*a* of the control valve 4 in a gravity-drop position or an elevated position.

The pressure oil from a pressure oil source 7 flows through the manually-operated control valve 4 into the fluid pressure circuit 3 where the pressure oil is converted into fluid pressure signals (hydraulic signals) to control the cargo handling valve 2. The relationship between the pressure of hydraulic signals and the spool movement of the cargo handling valve 2 is shown in FIG. 5. The pressure oil from the cargo handling valve 2 controls the cargo handling device 1 such as a cargo handling hydraulic cylinder.

The retainers 5, 6 are used, when loading earth or gravel into a dump truck or the like, to automatically put a boom to a stop at a predetermined height without the need for a driver to keep operating the lever 4*a* while driving the truck forward, and to lower the boom to the ground level while driving the truck in reverse. The retainers comprise an electromagnet 6A to retain the lever in a gravity-drop position and an electromagnet 6A to retain the lever in an elevated position. While the boom is being raised, a limit switch 8 is actuated to release the rataining power of the electromagnet 6A, which turns the control valve 4 to a neutral position, which further turns the cargo handling valve 2 to a neutral position. Consequently, the boom is kept at a predetermined height.

But since the limit switch 8 is provided in a fixed position, and no limit switch to be used at the time of gravity-drop is provided, an operator has to measure the height of the boom by the eye when it is descending by gravity and release the electromagnet 5A at the proper time and switch the lever 4*a* in a neutral position.

Also when the boom is about to stop at a higher stop point or a lower stop point the boom can fall by gravity so far, it tends to come to an abrupt stop and the operator feels uncomfortable.

An object of the present invention it to obviate the abovesaid shortcomings.

In accordance with the present invention, there is provided an apparatus for controlling cargo handling position in which the lower stop point and the higher stop point of the boom can be preset in desired position, and the shocks produced when the boom comes to stops at the elevated point and at the lower end point can be absorbed.

Other features and objects of the present invention will become apparent from the following description taken with reference to the accompanying drawings, in which, FIG. 1 is a circuit diagram of an apparatus for controlling cargo handling position representing the first embodiment of the present invention;

The components having the same functions as conventional ones are represented by the same reference numerals.

Figure 1:
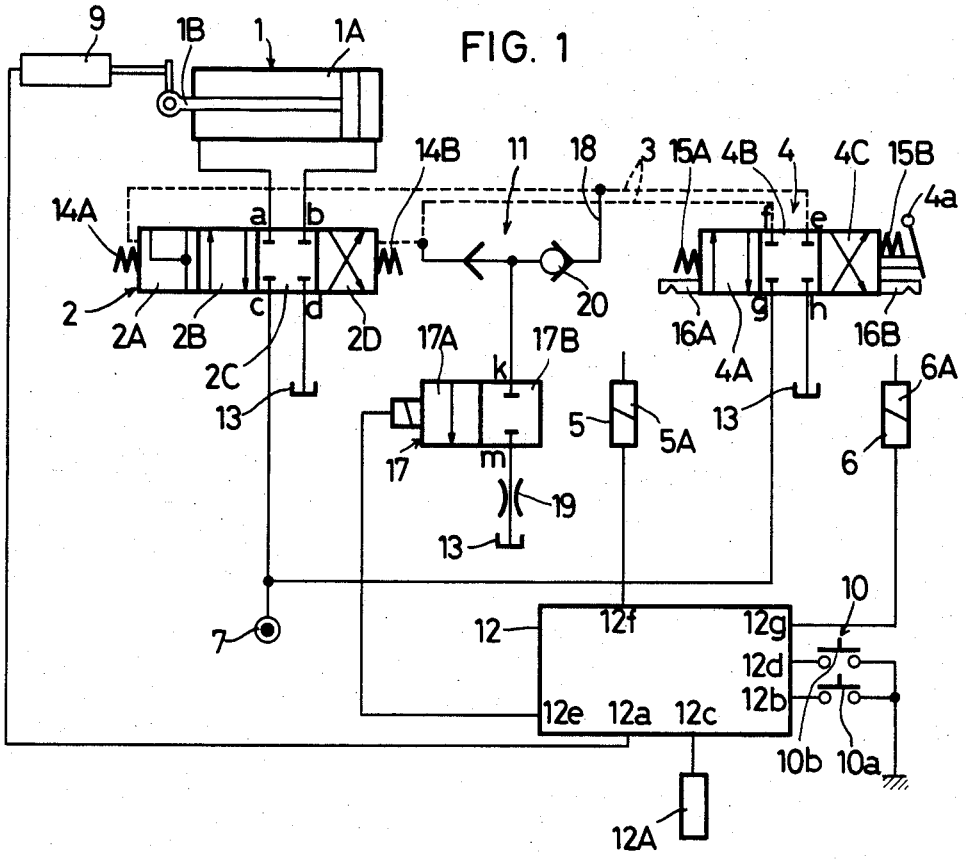

Referring now to FIG. 1 in which the first embodiment of the present invention is shown, the apparatus for controlling cargo handling position according to this embodiment comprises a cargo handling valve 2 to control a cargo handling device 1 formed with a hydraulic cylinder or the like, a control valve 4 connected to the cargo handling valve 2 through a fluid pressure circuit 3 which emits fluid pressure signals for changeover of valve position, retainers 5 and 6 to retain a lever 4*a* of the control valve in a gravity-drop position or an elevated position, a position sensor 9 to sense the elevated and lowered positions of the cargo handling device 1, a presetting unit 10 to set the elevated position and the gravity-drop position of the cargo handling device 1, a shock absorber 11 for reducing the hydraulic pressure applied through the fluid pressure circuit 3, and a controller 12 for controlling the retainers 5, 6 and the shock absorber 11 on the basis of signals taken from the position sensor 9 and the presetting unit 10. The controller 12 has the memory function of memorizing the signals from the presetting unit 10, the comparison and decision function of comparing output signals from the memory function with output signals from the position sensor 9, the shock absorber control function of transmitting output signals to the shock absorber 11, which signals are induced by output signals from the comparison and decision function, and which cause the fluid pressure to decrease and retainers control function of transmitting release signals to the retainers 5 and 6 after the transmission of signals from the shock absorber control function.

The cargo handling device 1 is a cargo handling cylinder for elevating or lowering a boom. The cylinder body 1A is secured to the truck body, and the piston rod 1B is secured to the boom which is rotatable relative to the truck body. The boom is elevated as the cylinder 1 is extended, and is lowered as the cylinder is telescoped.

The cargo handling valve 2 is a 4-position changeover valve comprising a port a connected to the cylinder body 1A so as to allow the hydraulic fluid to give a return stroke to the piston rod 1B, a port b connected to the cylinder body 1A so as to allow the hydraulic fluid to give a power stroke to the piston rod 1B, a port c connected to a hydraulic pressure source 7 and a port d connected to a hydraulic pressure tank 13. In the first position 2A of the cargo handling valve 2, the port a and the port b are interconnected, in the second position 2B the ports a and b are interconnected to the ports c and d, respectively, in the third position 2C, the interconnection with every port is cut off, and in the fourth position 2D, the ports a and b are interconnected to the ports d and c, respectively. The fluid pressure circuit 3 is connected to the outer ends of the first position 2A and the fourth position 2D of the cargo handling valve 2. Reset springs 14A and 14B are arranged thereon, too.

The control valve 4 is a 3-position changeover valve having a port e connected to the first position 2A of the cargo handling valve 2 through the fluid pressure circuit 3, a port f connected to the fourth position 2D of the cargo handling valve 2, a port g connected to the hydraulic pressure source 7 and a port h connected to the tank 13. The ports f and e are interconnected to the ports g and h respectively in the first position 4A of the control valve 4. Connection with each port is cut off in the second position 4B, and the ports f and e are interconnected to the ports h and g respectively in the third position 4C. The lever 4*a*, as well as a rest spring 15B, is provided at the outer end of the third position 4C, while another spring 15A engages at one end against the end face of the first position 4A.

The fluid pressure circuit 3 is a hydraulic circuit which serves to change over the valve position of the cargo handling valve 2.

The retainers 5 and 6 comprise a pair of engagement tips 16A and 16B secured to the right and the left outer ends of the control valve 4, an electromagnet 5A for a gravity-drop position which engages the engagement tip 16A and holds the control valve 4 in the third position 4C, and an electromagnet 6A for an elevated position which engages the engagement tip 16B and holds the control valve 4 in the first position 4A.

The position sensor 9 is a potentiometer one end of which is secured to the tip of the piston rod 1B of the cylinder acting as a cargo handling device 1.

The presetting unit 10 comprises a plurality of switches 10*a* and 10*b* which transmit ON-OFF signals to the controller 12. The controller 12 is a one-chip microcomputer in which data RAMs, programmable ROMs, ALUs and the like are actuated by a reference clock oscillating circuit. The controller 12 includes input terminals 12*a* and 12*b* for inputting the signals from the position sensor 9 and presetting unit 10, a terminal 12*c* for inputting the signals from a control switch 12A, output terminals 12*e*, 12*f*, 12*g* to transmit signals to the shock absorber 11 and the electromagnets 5A and 6A. Back-up power supply is arranged so as to prevent the memory stored in the RAMs in the controller 12 from being lost.

The shock absorber 11 comprises an electromagnetic valve changable in two positions with output signals from the controller 12, a shock absorbing circuit 18 by which the port k of the electromagnetic valve 17 is connected to the fluid pressure circuit 3, and a throttled portion 19 interposed between the port m of the electromagnetic valve 17 and the tank 13. A shuttle valve 20 is inserted in the shock absorbing circuit 18.

The electromagnetic valve 17 is a 2-position changeover valve including the first position 17A connecting the port k to the port m, and the second position 17B to cut off the connection between the port k and port m. An ON signal from the controller 12 will cause the valve to change its position from the second to the first position.

Figures 2, 5:
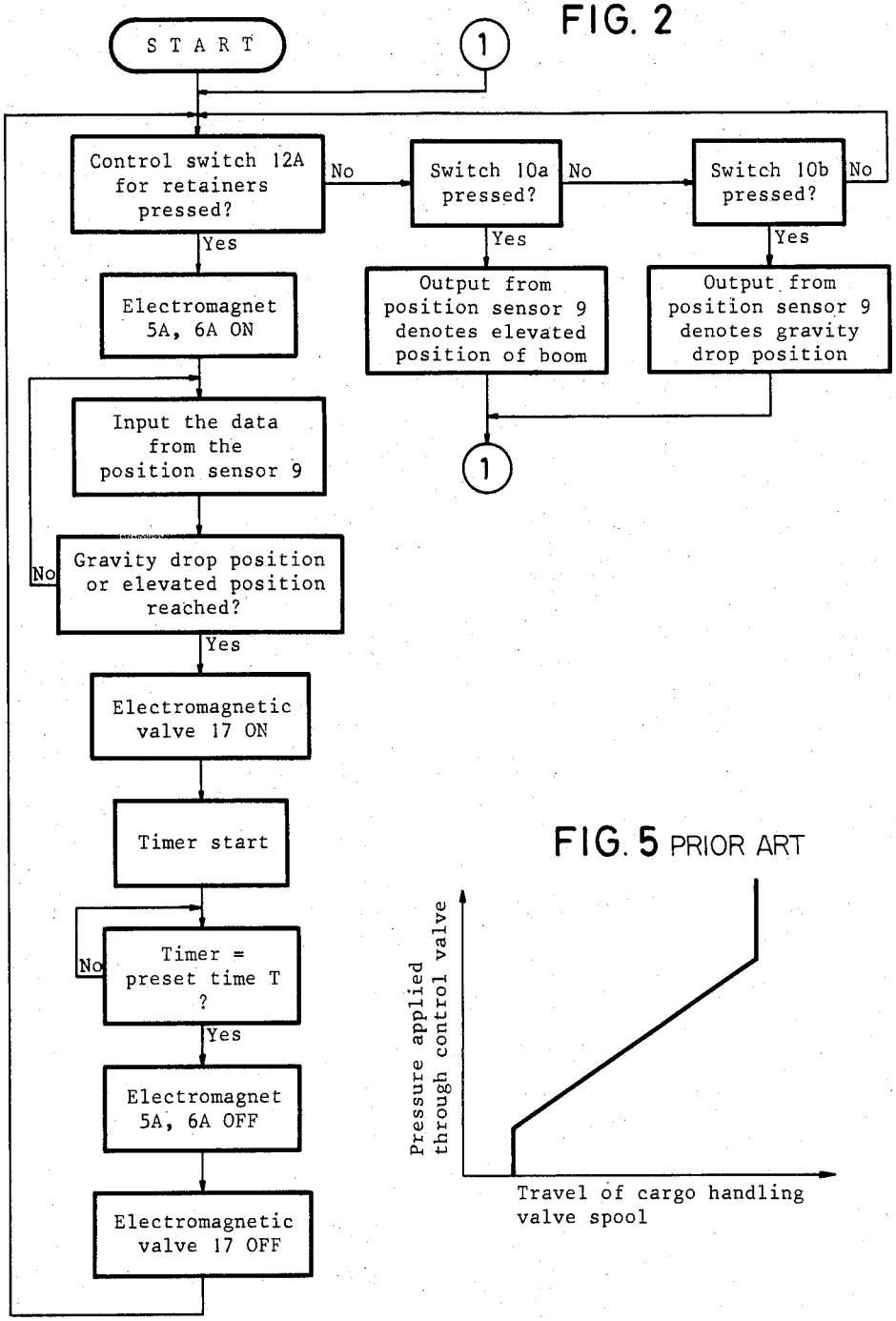
FIG. 5 PRIOR ART
FIG. 2 is a control flow chart of the same.
FIG. 5 is a view showing the relationship between the signal pressure of a control valve and the spool movement of a cargo handling valve.

Now let us explain how the apparatus works based upon a circuit diagram in FIG. 1 and a control flow chart in FIG. 2.

In ordinary operation of the boom, the lever 4*a* of the control valve 4 is operated so that the control valve 4 will be turned to the first position 4A or the third position 4C. Then a pressure oil will be fed to one end of the cargo handling valve 2, and switch the cargo handling valve 2 to the second position 2B or the fourth position 2D, so that the cylinder 1 will be extended or telescoped to elevate or lower the boom.

When it is desired to raise the boom to a height such as the bed of a dump truck, the retainers 5 and 6 are used. First, the cargo handling device 1 is manually adjusted to the height, and then the presetting unit 10 is operated to store information on the height in data RAMs mounted in the controller 12.

Next, the lever 4*a* is operated to switch the control valve 4 to the first position 4A, so that a pressure oil from the fluid pressure circuit 3 causes the cargo handling valve 2 to turn to the fourth position 2D. As a result, the pressure oil will be fed to the body of the cylinder 1 and the cylinder 1 will be extended. Then, a signal from the controller 12 actuates the electromagnet 6A for bringing the boom to a stop in an elevated position, so that the tip of the iron core is engaged with the cutout of the engagement tip 16B, and the control valve 4 is held in the first position 4A.

Every information on the extent of extension of the cylinder 1 is inputted into the controller 12 from the position sensor 9. The controller 12 compares the position information inputted from the position sensor with the position preset by means of a presetting unit 10. When the former coincides with the latter, the controller gives off an OFF signal, releasing the engagement with the engagement tip 16B, and the control valve is back to the neutral position (the second position 4B) by the spring 15B.

In this operation, the controller 12 transmits an actuating signal to the electromagnetic valve 17 of the shock absorber 11 just before emitting the OFF signal to the electromagnet 6A. The electromagnetic valve 17 is switched to the first position 17A, and the pressure oil supplied from the source 7 through the ports g and f and the circuit 3 is admitted into the tank 13. Since the pressure oil flows out of the fluid pressure circuit 3 slowly owing to the throttled portion 19, the pressure exerted on both ends of the cargo handling valve 2 also changes slowly. By the time the control valve 4 is back to the neutral position by disengagement from the engagement tip 16B, the pressure difference between both ends of the cargo handling valve 2 barely exists, and hydraulic pressure supply to the cylinder is reduced. Consequently, the cargo handling device 1 can be stopped smoothly without making a big impact noise.

When it is desired to bring down the boom from the bed of a dump truck for the next operation while driving the truck in reverse, this will be easily done by making use of a gravity-drop. To do this, the lever 4*a* is turned to change over and maintain the control valve 4 in the third position 4C, then the cargo handling valve 2 is switched to the first position 2A, thus the boom is free to fall by gravity.

Using the retainers 5 and 6 will further facilitate the operation while driving the truck in reverse. Namely, the control valve 4 is switched to the third position 4C by the lever 4*a*, and the electromagnet 5A is actuated by the control switch 12A to engage the engagement tip 16A to hold in a gravity-drop position. When the cylinder 1 is telescoped to such an extent that the boom is supposed to stop falling by gravity, the position of which has been preset by a signal from the position sensor 9, the controller gives off a signal to the electromagnetic valve 17 and switches the electrovalve 17 to the first position 17A. This causes the pressure oil in the fluid pressure circuit 3 to flow into the tank 13 slowly, and reduce the descending speed of the cargo handling device 1. Thereafter, an output signal from the controller 12 releases the electromagnet 5A, allowing the control valve 4 to be back to the neutral position (the second position 4B) and the cargo handling valve 2 to the neutral position to stop there.

Figure 3:
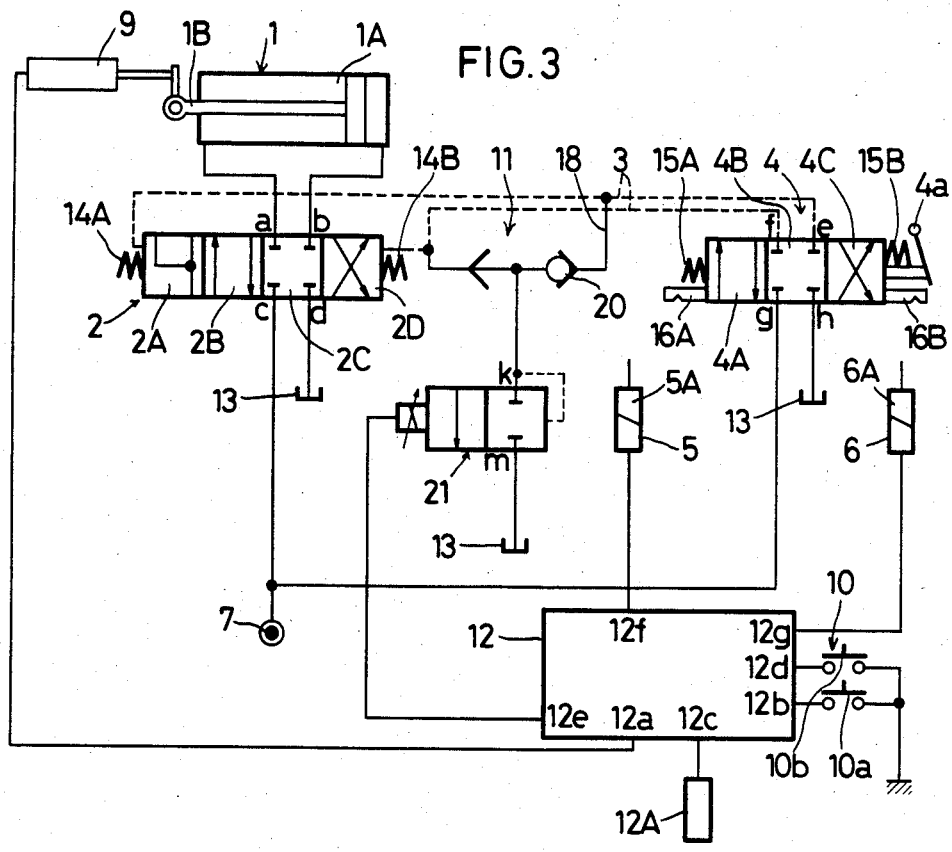
FIG. 3 is a circuit diagram of an apparatus for controlling cargo handling position showing the second embodiment of the present invention.
Figure 4:
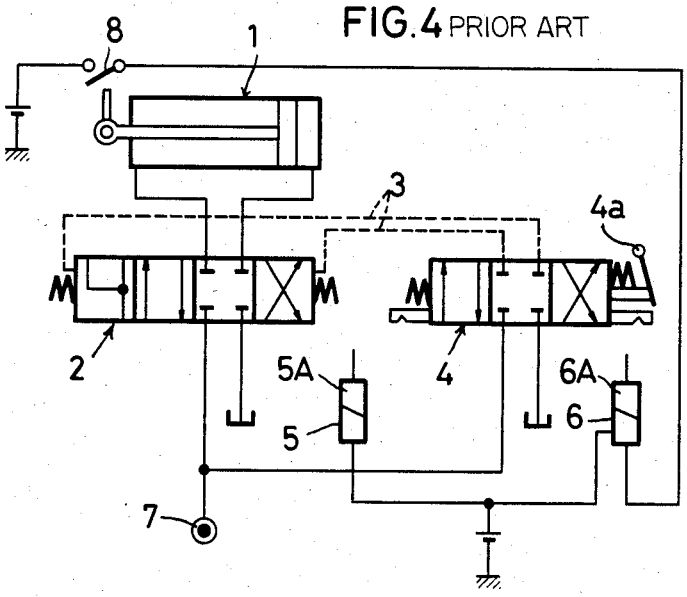
FIG. 4 PRIOR ART
FIG. 4 is a circuit diagram of a conventional apparatus for controlling cargo handling position.

Next, the second embodiment of the present invention will be described referring to FIG. 3. With an apparatus for controlling cargo handling position in this embodiment, a shock absorber 11 comprises an electromagnetic proportional valve 21 and a shock absorbing circuit 18. Other components are identical to those used in the first embodiment. The electromagnetic proportional valve 21 is controlled by pulse width modulation (PWM) in which the degree of opening of the valve varies with the intensity of electrical signals (electrical currents) transmitted from the controller 12. This arrangement eliminates the need for the throttled portion 19 in the first embodiment.

With the above structure, since the degree of opening of the valve varies with a change in intensity of the electrical signals from the controller 12, the speed of rise and fall of the boom can be controlled. Other functions and effects are substantially the same as the first embodiment.

As seen from the above description, the apparatus for controlling cargo handling position is characterised in that it comprises a cargo handling valve to control a cargo handling device formed with a hydraulic cylinder or the like, a control valve connected to the cargo handling valve through a fluid pressure circuit which-transmits fluid pressure signals for valve position changeover, retainers to retain a lever of the control valve in a gravity-drop position and elevated position, a position sensor to sense the elevated and lowered positions of the cargo handling device, a presetting unit to preset the heights of the elevated stop position and the lower stop position where a boom stops falling by gravity of the cargo handling device, a shock absorber to reduce the pressure of fluid pressure signals from a controller adapted to control the retainers and the shock absorber with output signals from the sensor and the presetting unit, and characterized in that the controller has the memory function of memorizing the signals from the presetting unit, the comparison and decision function of comparing output signals from the memory function with an output signal from the position sensor and giving a decision, the shock absorber control function of transmitting signals to the shock absorber which cause the fluid pressure to decrease, the above signals being induced by output signals from the comparison and decision function, and the retainers control function of transmitting release signals to the retainers after transmission of signals from the shock absorber control function.

In accordance with the present invention, both rising and falling of the boom can be stopped smoothly via the shock absorber without giving discomfort to the operator, and the operation of the apparatus while handling cargo is easy and simple.

What is claimed is:

1. An apparatus for controlling cargo handling position, comprising a cargo handling valve for controlling a cargo handling device such as a hydraulic cylinder, a control valve connected to said cargo handling valve through a fluid pressure circuit adapted to provide said cargo handling valve with hydraulic pressure for changing the position of a valve spool therein, a retainer for holding said control valve in a position adapted to spontaneously let fall a boom, another retainer for holding said control valve in a position adapted to hold said boom in an uppermost position, a position sensor for detecting the rise and fall of said cargo handling device, a presetting unit for presetting the uppermost and lowermost stop positions of said cargo handling device, a shock absorber for reducing the hydraulic pressure applied through the fluid pressure circuit, and a controller for controlling said retainers and said shock absorber on the basis of signals taken from said position sensor and said presetting unit, said controller having a function of storing the signals taken from said presetting unit, a function of comparatively evaluating the signals taken from said presetting unit and those taken from said position sensor, a function of controlling said shock absorber by feeding a control signal thereto for effecting a hydraulic pressure drop on the basis of the result of said comparative evaluation, and a function of controlling said retainers by feeding signals thereto for releasing said retainers when said shock absorber has been fed with said control signal.

* * * * *